United States Patent [19]

Avant

[11] 4,119,153

[45] Oct. 10, 1978

[54] TAMPER-PROOF FIRE EXTINGUISHER

[75] Inventor: Richard H. Avant, Churchville, N.Y.

[73] Assignee: Bernzomatic Corporation, Rochester, N.Y.

[21] Appl. No.: 737,763

[22] Filed: Nov. 1, 1976

[51] Int. Cl.[2] ..... A62C 13/00

[52] U.S. Cl. ..... 169/75; 169/89

[58] Field of Search ..... 169/74, 75, 89; 239/591, 600; 340/303; 85/37; 403/2; 285/4

[56] References Cited

U.S. PATENT DOCUMENTS

| | | | |
|---|---|---|---|
| 2,458,152 | 1/1949 | Eakins | 85/37 X |
| 2,586,088 | 2/1952 | Reeves | 169/89 |
| 3,666,016 | 5/1972 | Estes | 169/75 |
| 3,702,637 | 11/1972 | Bower | 169/75 |
| 3,794,057 | 2/1974 | Badger | 285/4 X |
| 3,835,615 | 9/1974 | King, Jr. | 285/4 X |
| 3,844,356 | 10/1974 | Allen et al. | 169/75 |
| 3,889,758 | 6/1975 | Dunn | 169/74 |

*Primary Examiner*—Joseph F. Peters, Jr.
*Assistant Examiner*—Michael Mar
*Attorney, Agent, or Firm*—Burgess, Dinklage & Sprung

[57] ABSTRACT

A hand-held fire extinguisher having a cylinder containing a fire extinguishing mass under pressure, a plunger valve in communication with a nozzle, a trigger for opening the valve which is pivotally connected to the body of the valve and a handle facing the trigger. The valve body has a bore and a pair of apertures in the trigger aligned with both ends of the bore. A breakable sealing pin having points of weakness is inserted in the bore and the aligned apertures in the trigger. The trigger has a pair of opposed sides spaced from and parallel to the valve body which contain the apertures. The trigger sides are positioned so as to be outside of any vertical plane which would pass through the valve body.

8 Claims, 4 Drawing Figures

TAMPER-PROOF FIRE EXTINGUISHER

BACKGROUND OF THE INVENTION

1. Field of the Invention

This invention relates to a fire extinguisher especially a hand-held portable fire extinguisher. More particularly, this invention provides a means of insuring that the extinguisher has not been tampered with or inadvertently discharged.

2. Discussion of the Prior Art

Numerous means for sealing fire extingushers to prevent tampering or inadvertent discharge have been provided. Such a device is disclosed for instance in U.S. Pat. No. 3,666,016 wherein a plastic pull ring is provided having a strand with resilient, relatively thin sections including a group of wedge-shaped fingers. Such a strand is described in U.S. Pat. No. 3,467,427.

The pull pin passes through the plunger and is held in place by a sealing member disposed on the exterior of the plunger opposite to the entry point of the pin. In operation, the pin is pulled which causes a thin section of the strand or the exterior sealing member to break.

Such a device requires a specially molded and dimensioned pin having a notched tip and a specifically sized and dimensioned sealing member which protrudes from the side of the plunger of the fire extinguisher. In operation, a distinct disadvantage is realized. The pull pin is severed principally at points of weakness. Since this is the weakest point of the pin, it means that even upon sever of the pin there is a likelihood that a portion of the pin shaft can remain in the channel through which it has passed to prevent the immediate discharge of the fire extinguisher.

It has therefore become desirable to provide a tamper proof fire extinguisher in which the seal is broken upon actuation of the plunger thereby permitting the contents of the cylinder of the fire extinguisher to be immediately discharged. Moreover, it has become desirable to provide such a system whereby manual pin removal is not required. It has become particularly desirable to provide a sealing system which eliminates externally disposed pull pins.

SUMMARY

Broadly this invention provides a hand-held fire extinguisher comprising a cylinder having a fire extinguishing mass therein under pressure, a plunger valve in fluid communication with a nozzle, a trigger for opening said valve which is pivotally connected to the body of the valve and a handle facing the trigger. Within the body of the valve is a bore which is in registry with a pair of apertures on the trigger on either side of the bore. A breakable sealing pin passes through both of the apertures and the bore.

Preferably, the fire extinguisher employs a sealing pin disposed entirely within the fire extinguisher unit itself which has two notched points of weakness. Generally, the sealing pin has a circular cross-section and is completely cylindrical except for the notched points of weakness which form V-shaped grooves about the periphery of the pin. The sealing pin is made of a friable plastic substance and is secured exteriorly of a pair of downwardly extending side members of the trigger by enlarged ends. Preferably, there are clearance spaces between the sides of the trigger and the valve body and the points of weakness of the sealing pin are positioned in the clearance space on each side of the valve body.

Thus, the sealing system of this invention positively unites the trigger to the valve body thereby insuring that there are no exterior elements with which one could tamper.

In the fire extinguisher of the invention, the handle preferably has a raised linear seam. This seam disposed on the upper surface provides additional strength to the handle. Preferably, the seam has a height at its end proximate the valve itself greater than at the tip of the handle opposed from the valve. This seam meets the valve body itself where it is comolded with the bore for receiving the sealing. Thus, the bore for receiving the sealing pin is integral with the valve body and the handle.

The trigger for actuation of the fire extinguisher preferably has a pair of opposed side members integral and comolded therewith. These side members contain the apertures through which the sealing pin passes. The side members are disposed in generally vertical planes which are disposed on either side of the valve body and lie in vertical planes which would not pass through the handle. Preferably, the fire extinguisher includes a pressure gauge indicating the pressure of the contents of the cylinder. This permits the user to be consciously aware of the extent to which the cylinder is charged. The sealing system positively prohibits the inadvertent discharge of any of the contents thereby insuring that the fire extinguisher is always ready for emergency use.

DESCRIPTION OF THE DRAWINGS

This invention can be more readily understood and appreciated when reference is made to the accompanying drawings in which.

DESCRIPTION

Figure 1:
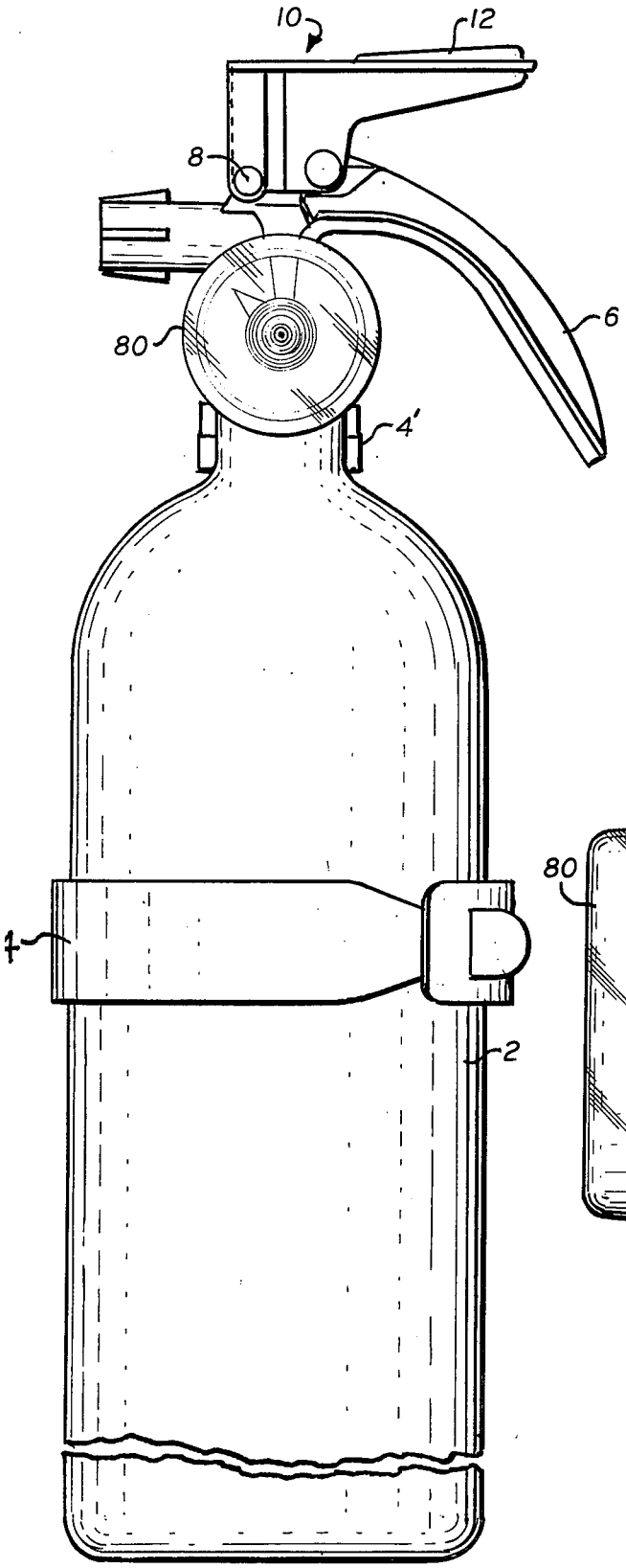
FIG. 1 is a side elevational view of the fire extinguisher of the invention.

Referring to the drawings, the fire extinguisher of this invention comprises a cylinder 2 containing a fire extinguishing mass under pressure. The cylinder can contain any fire extinguishing mass in solid, liquid or gaseous form. The sealing assembly of the present invention can be used for those fire extinguishers containing fire extinguishing gases such as $CO_2$ as well as those fire extinguishers which dispense liquids such as carbon tetrachloride. The assembly is particularly useful, however, for dispensation of dry powder which is contained within the cylinder under pressure. The cylinder can also contain a foam fire extinguishing material.

Figure 3:
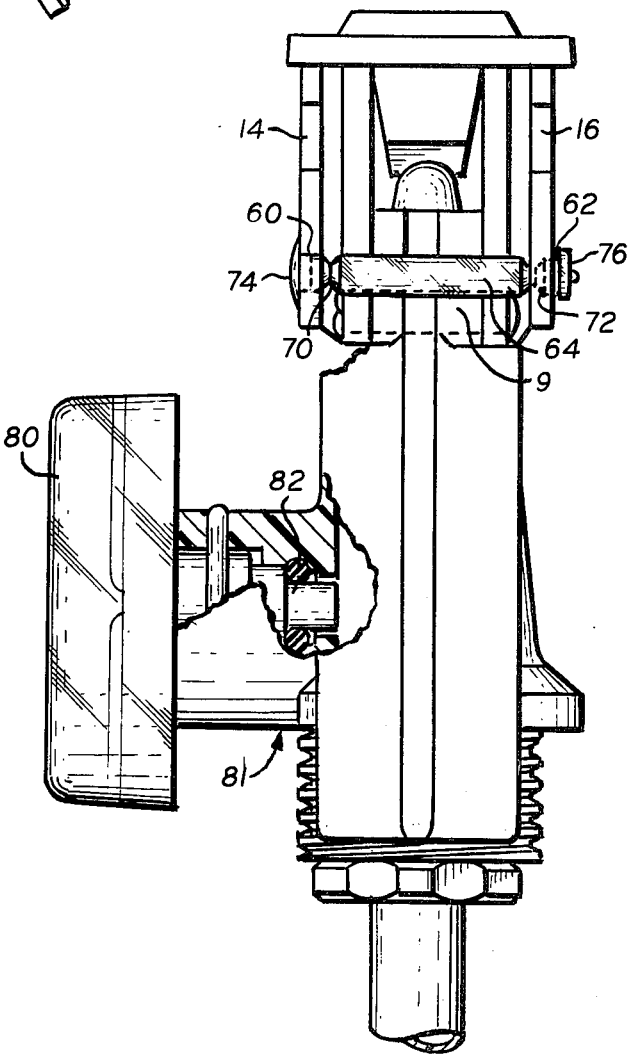
FIG. 3 is an enlarged rear view of the valve, nozzle, handle and plunger assembly of the fire extinguisher.

The cylinder terminates in a valve body 5 to which is connected a handle 6. Pivotally connected at pivot 8 is a trigger 10 having finger lever 12 and a pair of oppose downwardly extending side members 14 and 16 parallel to and spaced from the sides of the valve body (FIG. 3).

Figures 2, 4:
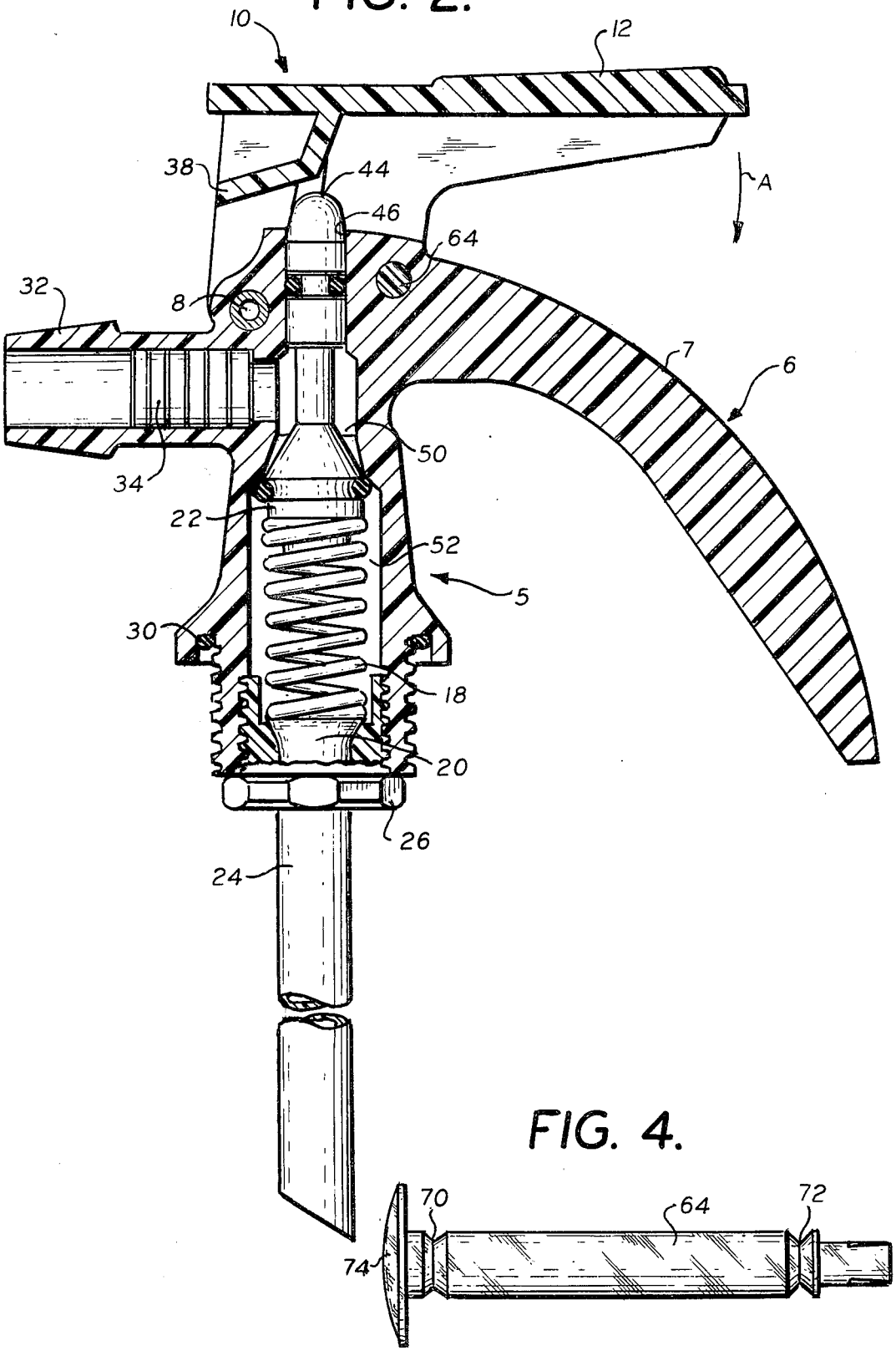
FIG. 2 is an enlarged sectional view of the nozzle, plunger, handle and valve assembly of the invention.

Referring to FIG. 2, the valve body 5 contains therewithin a spring 18 which is biased against the flared end 20 of siphon tube 24 and the lower portion 22 of plunger 44.

The valve assembly comprises a flared siphon tube 24 which is held in place by spring 18 and nut 26 threaded onto the end of the valve body 5. The valve body is made of plastic material such as a polyolefin, polyamide, e.g., nylon, vinyl polymer or copolymer, polycarbonate, polyester, polyurethane or copolymers such as ABS, styrenebutadine and the like, polystyrene, polyimides and the like, as well as phenolformaldehyde, ureaformaldehyde, melamineformaldehyde or like molding compositions. The sealing pin is formed of a readily friable or brittle, hard plastic such as polyacrylic, polystyrene and the like.

The valve body 5 is screwed into the neck of container 2 and sealed by means of O-ring 30. The valve body itself has comolded and integral therewith a nozzle 32 having a nozzle insert 34 of a ribbed cylindrical member to provide support for the plastic valve body at the point where the pressurized charge passes therethrough. The interior of nozzle 32 cold flows around the ribs of insert 34 for a secure fit. Insert 34 controls the discharge pattern and blossom.

The means for actuating the plunger valve comprises a bevelled protrusion 38 disposed below the finger lever 12 of the trigger 10. This bevelled surface 38 is positioned in alignment with a plunger 44 disposed within a channel 46 whereby when the finger lever 12 is compressed toward the handle 6, the bevelled member 38 depresses the plunger 44 biased against the spring 18 to allow the valve 50 to open thereby permitting the fire extinguishing mass to pass from tube 24, through the conduit 52 from the valve 50 and out the nozzle 32.

Referring to FIGS. 2 and 3, on side walls 14 and 16, there are positioned apertures 60 and 62 through which a sealing or fracture pin 64 passes. This fracture pin operates as the sealing pin to prevent inadvertent discharge of the contents of the fire extinguisher. The fracture pin 64 has a generally cylindrical body in which there are two points of weakness. These points of weakness are V-shaped grooves about the periphery of the fracture pin. The points of weakness are designated by reference numerals 70 and 72 and are positioned to lie generally in the clearance space between side members 14 and 16 and the valve body 5 (FIG. 3). Disposed exteriorly of the walls 14 and 16 are flanges 74 and 76 which overlie the surface walls 14 and 16. The pin 64 is first formed with an enlarged head 74 and the other end 76 is enlarged by heating after the pin is in place. A mechanical device such as a snap nut can be used in lieu of the enlarged end 76.

The fire extinguisher preferably is provided with an exteriorly disposed pressure gauge 80 connected to the valve body through an O-ring 82 which measures and displays the pressure of the contents of the cylinder on the closed valve.

In operation, referring to FIG. 2, the user grasps the handle 6 by placing his four fingers between the downwardly descending handle 6 and the valve body thereby allowing for disposition of the thumb on the finger lever 12. The finger lever 12 is then compressed in the direction of arrow A toward the handle 6. This permits the pin 64 to be severed generally in the clearance spaces at the V-shaped grooves 70 and 72 allowing for free, unobstructed downward movement of the plunger system through actuation of the member 38 with the plunger 44. Spring 18 forces plunger 44 up to close the valve when the lever 12 is released.

A preferred construction of the sealing system of the invention is shown in FIGS. 1 and 3. The handle 6 contains a raised seam 7 which has a pike proximate the valve body greater than at the opposed end of the handle. This seam is integral and comolded with the bore 9 through which the fracture pin 64 passes. Thus, the entire valve body, handle and nozzle are all comolded in a one-piece construction. Preferably, the body of the gauge 80 is also comolded therewith as seen by reference numeral 81 of FIG. 3.

It is evident that the construction of the present invention is simple and guarantees that the sealing system is not inadvertently broken since the sealing system is virtually entirely interior the downwardly descending side plates 14 and 16 of the trigger 10 with the points of weakness generally in the clearance spaces between the valve body. Thus, inadvertent breaking of the sealing system is positively precluded. Moreover, in actuation, the fracture pin 64 can readily be broken by actuation of the finger lever 12 thereby insuring that the bevelled member 38 can engage the plunger 44 to commence the fire extinguishing operation.

Recharging the extinguisher is carried out in the conventional way and a new fracture pin 64 can easily be inserted and the end 76 enlarged by heating to lock the pin in place. The fire extinguisher can then be used over and over.

A mounting bracket being a strap 4 and a neck engaging member 4' can be used to conveniently mount the fire extinguisher. Such a bracket is shown in U.S. Pat. No. 3,565,384, issued on Feb. 23, 1971.

What is claimed is:

1. In a hand-held fire extinguisher having a cylinder with a fire extinguishing mass therein under pressure, a valve in communication with a nozzle, a trigger for opening said valve which is pivotally connected to the body of said valve and having two opposed side members, and a handle facing said trigger, the improvement wherein the body of said valve has a bore and the trigger has a pair of apertures in said side members and aligned with the ends of the bore, a breakable sealing pin inserted in the valve bore and through both of the aligned trigger apertures, said sealing pin having enlarged end portions exterior of the apertures for maintaining the pin in a substantially fixed longitudinal position and means for effecting the severing of same upon movement of the trigger to discharge the fire extinguisher comprising two points of weakness disposed at opposite end portions of the pin and aligned between the trigger side members and the ends of the bore when the pin is fixed in position by the enlarged end portions.

2. Fire extinguisher of claim 1 wherein the two points of weakness comprise two notched points.

3. Fire extinguisher of claim 2 wherein said notched points of weakness are V-shaped grooves.

4. Fire extinguisher of claim 1 wherein said side members are disposed in vertical planes outside of the vertical plane which passes through the valve body.

5. Fire extinguisher of claim 4 wherein said side members form clearance spaces on both sides of the valve body and the points of weakness are disposed in the clearance spaces such that the sealing pin is adapted to be severed in said clearance spaces.

6. Fire extinguisher of claim 1 which includes a pressure gauge for indicating the pressure of the contents of said cylinder.

7. Fire extinguisher of claim 1 wherein the nozzle has a ribbed insert and the interior of the nozzle cold flows around the ribs of said insert, said insert controlling the discharge pattern and blossom.

8. Fire extinguisher of claim 1 wherein the valve includes a siphon tube held in place by a spring in the valve which biases the valve closed.

* * * * *